United States Patent [19]

Okada et al.

[11] 4,106,998

[45] Aug. 15, 1978

[54] METHOD OF RESTRAINING EMISSION FROM COKE QUENCHING EQUIPMENT

[75] Inventors: Yutaka Okada; Kyoji Sasaguri; Kazuo Ishihara, all of Yokohama, Japan

[73] Assignee: Nippon Kokan Kabushiki Kaisha, Tokyo, Japan

[21] Appl. No.: 516,826

[22] Filed: Oct. 21, 1974

[30] Foreign Application Priority Data

Oct. 25, 1973 [JP] Japan ..... 48/119433

[51] Int. Cl.[2] ..... C10B 45/00; C10B 27/04

[52] U.S. Cl. ..... 201/39; 202/227; 202/228; 202/262; 202/263; 202/269; 214/35 R; 214/18 PH; 214/17 B; 110/108; 34/169

[58] Field of Search ..... 201/39; 202/227, 228, 202/262, 263, 269; 214/35 R, 18 PH, 17 B; 110/108; 266/15, 19, 27; 34/168, 169

[56] References Cited

U.S. PATENT DOCUMENTS

| | | | |
|---|---|---|---|
| 958,184 | 5/1910 | Schulte | 201/39 |
| 1,814,787 | 7/1931 | Daae | 48/86 R X |
| 3,767,536 | 10/1973 | Ikeda et al. | 202/263 |
| 3,795,987 | 3/1974 | Kemmetmueller | 202/228 UX |
| 3,857,758 | 12/1974 | Mole | 214/35 R X |

*Primary Examiner*—James N. Tayman, Jr.
*Attorney, Agent, or Firm*—Moonray Kojima

[57] ABSTRACT

In a dry type quenching facility for red hot coke wherein an operation pressure at the upper portion of the quenching station is set up within the range of 0 to +10 $mmH_2O$, red hot coke is charged into said station under a reduced pressure of 0 to −30 $mmH_2O$, to prevent escape of dust and smoke from said station and thereby prevent polluting of the environment.

1 Claim, 3 Drawing Figures

METHOD OF RESTRAINING EMISSION FROM COKE QUENCHING EQUIPMENT

The present invention relates to an improved method of charging red hot coke into a dry type quenching facilities, and more particularly to a method of restraining the escape of dust and smoke from the quenching station during the time of charging of the red hot coke into said station and thus preventing the polluting of the environment.

Heretofore in the manufacturing process of coke, red hot coke removed from an oven were quenched. A method used in the prior art was loading the coke on a quenching car, driving the car into the quenching station and sprinkling water over the car, which is known as a wet type process. In this method, coke is cooled rapidly, consequently, many and small cracks generate thereon, thus reducing the yield of products. Recently, a so-called dry type method, wherein the coke is cooled by air and not by water, has been developed. The said method comprises placing the red hot coke into a vertical type closed station successively, passing a quenching gas through accumulated coke from the bottom and removing the coke thus cooled from the lower layer successively. This method enables one to obtain coke having high grade and good quality, but the method tended to give grave environmental problems as it generated a considerable amount of dust and smoke when the coke is charged into the station. In this type of dry quenching facility, coke removed from the oven is charged into the station from the top by opening the cover, using a chute or a bucket. Since the upper portion of the station is being operated under a pressure of 0 to $+10$ mm$H_2O$ or thereabout, the voilent emission of said dust and smoke from the charging hole, opened to receive the coke, occurs at a frequent interval of about 3 to 4 times per hour and particularly so when green coke is charged. This naturally causes environmental pollution for the work site within the plant as well as for the surrounding area.

As one counter-measures, for example, a dust-catcher is placed near the charging hole of red hot coke. However, the method may be defective as said dust catcher included a duct which is an obstacle to charging of said red hot coke into said quenching station. Also, this will require a great amount of initial and running costs. Moreover, the location of installation is high above the ground and the operations of the charging and the dust catacher become complicated and the operation frequency is low and intermittent. Other means such as placing a dust trap beneath the chute and pushing the lower end thereof onto the water sealing part of the charging hole may be envisaged. However, this method is also not without its limitations as a high temperature of about 1,000° C at said hole area will cause its deformation and subsequent difficulties in sealing or pulling out thereby. Thus, no suitable means or method has yet been found for preventing the emission of dust and smoke from the charging hole of the dry quenching station.

The present invention has been developed to eliminate the foregoing problems. A feature of this invention lies in the charging of said red hot coke into the quenching station under a negative pressure in the upper portion of the station which is controlled to be within the range of 0 to $-30$ mm$H_2O$.

An object of the present invention is to provide a method for restraining the atmospheric emission of dust and smoke from the charging hole when red hot coke is charged into the quenching station of the dry type quenching facilities.

Another object of the present invention is to provide a method for preventing pollution of the environment by restraining the emission of dust and smoke from the quenching station.

A further object of the present invention is to provide a method which can be carried out without any incidental maintenance expenses.

Other objects and advantages will be apparent from the following description and the accompanying drawings in which.

Figure 1:
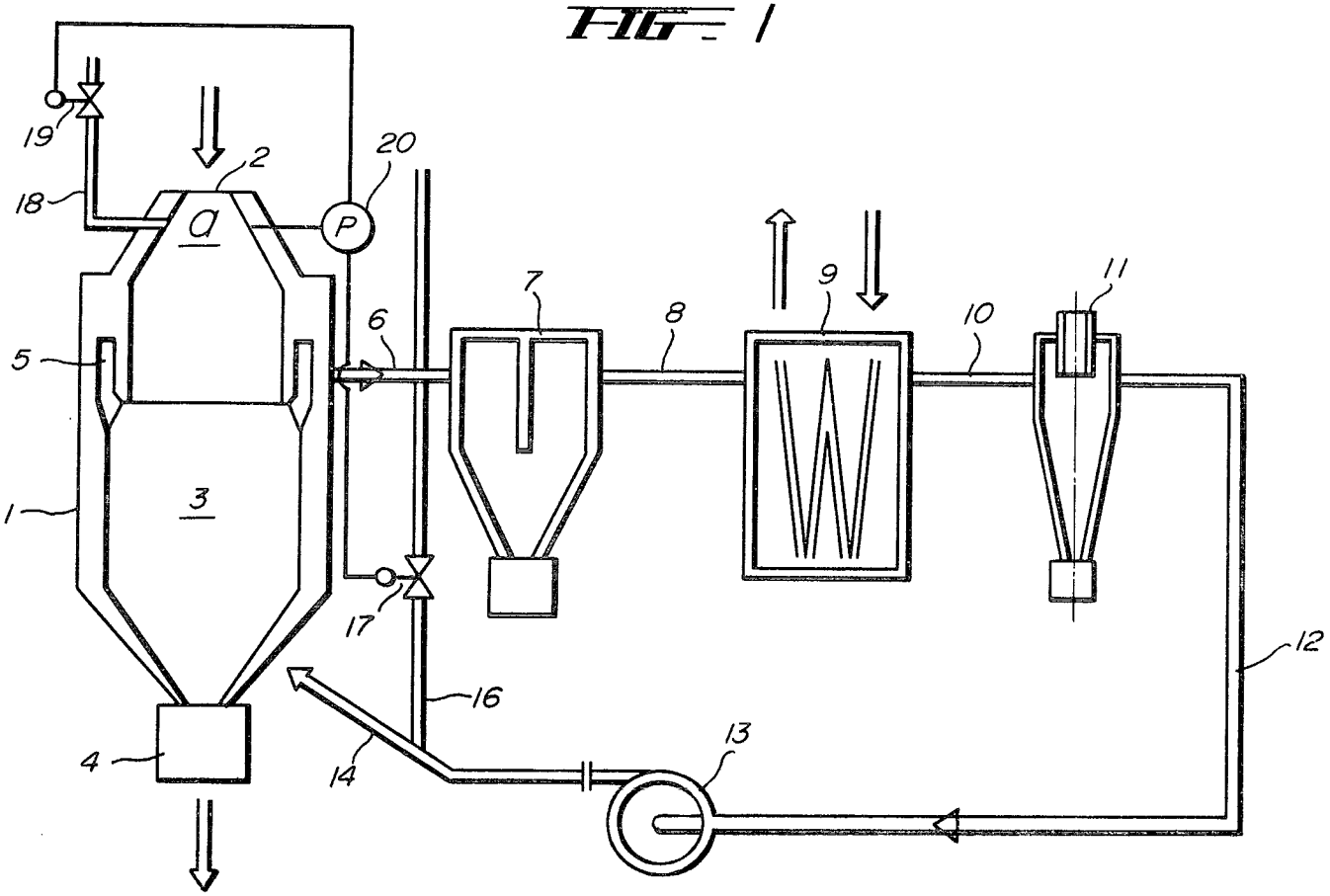
FIG. 1 depicts an illustrative embodiment of the present invention in a known dry type quenching facilities.

Now, referring to the accompanying drawings, a known dry type quenching system for red hot coke is shown in FIG. 1. Numeral 1 denotes a quenching station in a dry type quenching facility. Red hot coke is charged into and accumulated in the quenching chamber 3 through hole 2 at top of station 1 and is taken out from a discharging port 4 at bottom of station 1 after having been quenched. The method of quenching for such coke comprises feeding a quenching gas from the bottom of said chamber 3, passing the gas through said chamber from the bottom to the top, inducing the gas out of the exhaust port 5 provided at the top of said chamber 3, leading the gas to the dust catcher 7 via a circulating gas duct 6 connected to said exhaust port 5. The gas is then transmitted to heat exchanger 9 such as waste heat boiler via a duct 8 for cooling and then the cooled gas is sent to a cyclone 11 via the duct 10 for further elimination of dust. The thusly cooled and purified gas is then sent to the fan 13, via a duct 12, to be fed again into the quenching chamber 3 in the above mentioned manner to be passed through the accumulated of coke layer and to be exhausted from the exhaust port 5 in a circulatory manner. The circulating gas comprises air at the start a gas comprising the operation and becomes of $CO_2$: 5%, CO: 14%. $O_2$: 1%, $H_2$: 4%, $N_2$: 75% allowing for a slight variation during the operation.

In general, the following means are further added to the above-mentioned circulating system. That is, first a gas bleeder 16 is connected to said duct 14 feeding said quenching gas into said chamber 3 and a relief valve 17 is set up to said bleeder 16. Secondary, another gas bleeder 18 is arranged at the upper portion *a* of said chamber 3 and another relief valve 19 is set up at said bleeder 18. Thirdly, a pressure detecting means 20 is arranged at said upper portion *a* of said chamber 3. The reason why the above mechanism is incidentally added to said quenching facility was for releasing an abnormal state of said station 1. For example, when flow rate of the quenching gas is rapidly increased for some reasons, such as, a gas escapes into the atmosphere via said breeder 16 by opening of said relief valve 17. Or, when the internal pressure of said upper part *a* is abnormally increased, the relief valve 19 is opened and said gas is allowed to escape into the atmosphere via said bleeder 18. In any case, it is needless to say that such operations are carried out for securing safety of said station 1 and maintaining stability of quenching work.

In the present invention, the above mentioned relief valves 17 and 19 play an important part as an automatic controlling means, not as a simple relief mechanism, that is, as control valves. For this reason, said relief valves 17 and 19 are connected with the internal pressure detecting means 20, respectively. (Since the automatic control mechanism is possible to be built with ease, the mechanism is not shown in the accompanying drawings.) In such a case, the internal pressure of said upper portion *a* is possible to be adjusted to the required value by the automatic link motion between said control valves 17 and 19 and said pressure detecting means 20. The above required pressure at the upper portion *a* of chamber 3 is selected to be preferably within the range of 0 to $-30$ mm$H_2O$, that is, the pressure of said upper portion *a* is negative.

Figure 2:
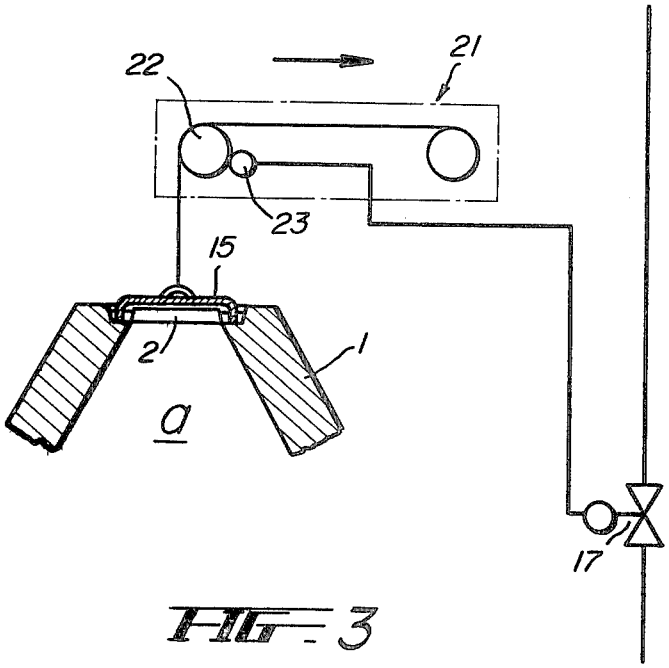
FIG. 2 depicts a link mechanism between the means for opening the control valves and the uncovering mechanism for the charging hole.
Figure 3:
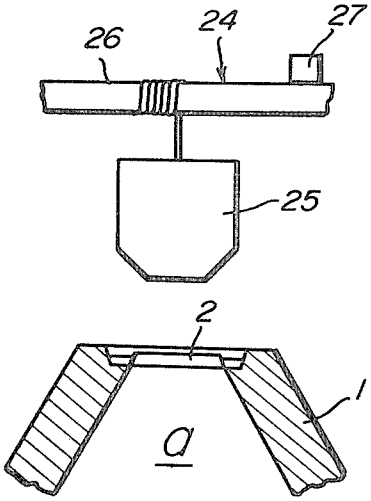
FIG. 3 depicts of a link mechanism between the means for opening the control valves and the charging mechanism for red hot coke.

FIG. 2 and FIG. 3 are an example of link motion between the control valve 17 and 19, the pressure detecting means 20 and other operation mechanism, respectively. In FIG. 2, the start and the end of action of said control valves 17 and 19 are linked to that of uncovering mechanism for the charging hole 2. That is, a device of detecting revolving number 23, i.e. a tachometer, is fitted to a winding pulley 22 of a winding mechanism 21 for said cover 15. On the occasion of charging red hot coke, said tachometer 23 detects the time when the cover 15 is lifted, say for 1m, at this time, the control valve 17 is opened by an opening automatically selected by a detecting value of the pressure gauge 20. Simultaneously, another control valve 19 is shut (preferably, full shut-down). Then those of the valves are held for the time when a limit switch or a timer (not shown) will act. By such automatic actions of said valves, the required negative pressure at the upper portion *a* of said chamber 3 is accomplished with ease. FIG. 3 is an example of linking with a charging mechanism 24 for red hot coke. That is, a tachometer 27 is fitted to a hoisting drum 26 of a coke bucket 25 in the coke charging mechanism 24. After uncovering, a going-down distance of said bucket 25 reaches about 1m is detected by said tachometer 27 the opening and shutting manners of said valves 17 and 19 thereby are as mentioned above.

According to the usual operations, the known dry type quenching facility is operated under the pressure of 0 to $+10$ mm$H_2O$ at the time when red hot coke is charged into the station. In the present invention, the facilities is operated under negative pressure of 0 to $-30$ mm$H_2O$, which is accomplished by employing the known relief valves as the automatic control valves.

Now, the actual manner of operation of said valves of this invention is as follows. That is, when the control valve 17 automatically acts to open and another control valve 19 acts to shut as mentioned above, a quenching gas flows into the bleeder 16. By this manner, the outflow of said gas from another bleeder 18 becomes slight or zero. While the exhausting of said gas from the port 5 via the duct 6 goes on as before, the internal pressure at the upper portion *a* of the chamber 3 surely becomes negative. At this time, if the red hot coke is charged into the chamber 3, all of dust and smoke with charging coke are absorbed wholly into the quenching chamber without escape or emission from the charging hole 2. At the same time, dust from the coke at the top *a* of the quenching chamber 3 also does not escape, thereby facilitating optimum control of dust and smoke generation.

The air will be absorbed by the negative pressure at the time of the charge as above mentioned. However, there is no danger of exploding, but a slight combustion of coke will occur, since the temperature at the top portion *a* is usually about 1,000° C. The combustion loss of coke caused by the air absorbed can be reduced comparatively, because there exists combustible gas in said area and the combustion gas of coke is not 100% CO. However, too much negative pressure at said area cause to increase said combustion loss. Accordingly, the negative pressure should be set preferably within the needed and minimum range, i.e. 0 to $-30$ mm$H_2O$.

As mentioned above, when the charging of red hot coke has been finished and the charging hole has been covered, the operating of the quenching facility returns to normal, i.e. the operation under positive pressure of 0 to $+10$ mm$H_2O$, by the automatic action of the pressure gauge and the control valves. Thus, no emission of dust and smoke at the time when red hot coke is charged into the quenching station of the dry type quenching facilities occurs. Consequently, pollution of the environment can be avoided.

We claim:

1. A method of eliminating atmospheric emission of dust and smoke during the charging of hot coke into a quenching apparatus of the dry type, said apparatus having a quenching chamber with an upper portion and a lower protion, said upper portion having a charging port and means for covering said charging port located thereat, said lower portion having a discharge port located thereat, and means for supplying quenching gas to said lower portion of said quenching chamber and means for exhausting said gas from said chamber after quenching of said coke; said method comprising the steps of (A) Opening said covering means;

(B) charging said coke into said chamber through said charging port while said covering is open;

(C) bleeding said gas from said gas supplying means to outside of said chamber concurrently with the charging of said coke into said chamber through said charging port;

(D) preventing gas from being bled from the upper portion of said chamber concurrently with the charging of said coke into said chamber, whereby the internal pressure of said upper portion of said chamber is selectively controlled to be within the range of 0 to $-30$ mm$H_2O$ during the charging of said coke through said opening of said charging port with said covering means being open thereby to prevent emission of dust and smoke through said open charging port into the atmosphere during said charging of said coke;

(E) and closing said covering means after completion of charging of said coke into said chamber.

* * * * *